United States Patent [19]

Farcasiu et al.

[11] 4,171,260

[45] Oct. 16, 1979

[54] PROCESS FOR REDUCING THIOPHENIC SULFUR IN HEAVY OIL

[75] Inventors: Malvina Farcasiu; Eric J. Y. Scott, both of Princeton, N.J.

[73] Assignee: Mobil Oil Corporation, New York, N.Y.

[21] Appl. No.: 937,668

[22] Filed: Aug. 28, 1978

[51] Int. Cl.[2] ..... C10G 29/22; C10G 29/04

[52] U.S. Cl. ..... 208/240; 208/245

[58] Field of Search ..... 208/240, 231, 208 R, 208/226, 232, 245

[56] References Cited

U.S. PATENT DOCUMENTS

| | | | |
|---|---|---|---|
| 1,899,042 | 2/1933 | Malisoff | 208/240 |
| 2,270,058 | 1/1942 | Jones | 208/245 |
| 2,309,653 | 2/1943 | Leum et al. | 208/240 |
| 3,516,947 | 6/1970 | Dudzik | 208/245 |
| 3,835,031 | 9/1974 | Bertolacini et al. | 208/226 |

FOREIGN PATENT DOCUMENTS

| | | | |
|---|---|---|---|
| 465969 | 6/1950 | Canada | 208/245 |

*Primary Examiner*—George Crasanakis
*Attorney, Agent, or Firm*—Charles A. Huggett; Raymond W. Barclay

[57] ABSTRACT

This invention provides a method for reducing the level of thiophenic sulfur compounds in a heavy carbonaceous oil feed which involves contacting the oil feed with a $C_1$–$C_4$ alkanol in the presence of a non-acidic zeolite catalyst.

The reaction equilibrium in the process favors the displacement of thiophene sulfur atoms by oxygen atoms.

11 Claims, No Drawings

PROCESS FOR REDUCING THIOPHENIC SULFUR IN HEAVY OIL

BACKGROUND OF THE INVENTION

Heavy hydrocarbon feedstocks such as residual petroleum oil fractions and synthetic crude oils from coal usually contain a large amount of sulfur-containing organic contaminants, e.g., a sulfur content in excess of 1%. The organic sulfur compounds are in the form of mercaptans, and aliphatic and cyclic thioethers and thiophenes. Some of the sulfur compounds are readily removed by simple methods of treatment, such as extraction with solvents.

The thiophene type sulfur compounds are difficult to remove except by intensive methods which concurrently destroy or alter desirable hydrocarbonaceous components of the feedstock. The use of drastic conditions utilizing prior art procedures, such as air oxidation, causes the formation of extensive amounts of resins and coke.

Various approaches to the removal of sulfur-containing organic compounds are disclosed in the prior art. U.S. Pat. No. 2,114,852 proposes a process for removal of thiophene and alkylthiophene compounds from hydrocarbon feedstock which involves distilling the feedstock in the presence of a polar solvent which preferentially dissolves sulfur compounds. The distillation residue which contains substantially all of the sulfur and a major portion of the aromatics is subjected to a desulfurization treatment, such as selective hydrogenation or oxidation. The resultant desulfurized residue fraction is then blended with the distillate fraction which was previously separated in the distillation step.

U.S. Pat. No. 3,565,793 describes a two-step process for reducing the content of thiophene sulfur compounds of heavy hydrocarbon oils. In a first step, the oil feedstock is contacted with a peroxide oxidant in the presence of a Group IV-B, Group V-B or Group VI-B metal. In a second step, the peroxide-treated feedstock is subjected to base treatment (e.g., sodium hydroxide) or thermal treatment.

There remains a need for an economically feasible processing method for desulfurization of heavy hydrocarbon oil feedstocks which contain refractory sulfur compounds such as thiophenic derivatives.

Accordingly, it is a main object of this invention to provide a one-step process for desulfurization of hydrocarbonaceous oil feedstock.

It is another object of this invention to provide an efficient method for reducing the thiophenic sulfur content of heavy hydrocarbon mixtures such as residual petroleum oil fractions and coal-derived synthetic crude oils.

Other objects and advantages of the present invention shall become apparent from the accompanying description and examples.

DESCRIPTION OF THE INVENTION

One or more objects of the present invention are accomplished by the provision of a process for desulfurizing a thiophenic sulfur-containing heavy hydrocarbonaceous oil feed which comprises reacting the oil feed with a $C_1$–$C_4$ alkanol in the presence of a non-acidic zeolite catalyst at a temperature in the range between about 450° F. and 850° F.

The invention desulfurization process can be conducted as a batch or as a continuous operation. The desulfurization reaction may be conducted as a slurry process, a fixed bed process, a fluidized bed process or an ebullating bed process.

Heavy Hydrocarbon Feedstocks

The heavy hydrocarbon oil mixtures amenable to the present invention desulfurization process include those boiling above about 650° F., and which contain substantial proportions of constituents boiling above about 1000° F. Suitable heavy hydrocarbon oil mixtures are those recovered from tar sands and oil shales, and particularly the synthetic crude oils produced by the liquefaction of coal. The coal-derived heavy oil mixtures usually have a thiophenic sulfur content of at least 0.5 weight percent, and in most cases at least 1.0 weight percent.

Illustrative of other hydrocarbon oil mixtures are heavy crude mineral oils and petroleum refinery residual oil fractions, such as fractions produced by atmospheric and vacuum distillation of crude oil. Such residual oils contain large amounts of sulfur and metallic contaminants (e.g., nickel and vanadium). The total sulfur content may range up to 8 weight percent or more, and the thiophenic sulfur content is at least 0.6 weight percent on the average. The Conradson carbon residue of these heavy hydrocarbon fractions will generally range between about 5 and 50 weight percent (ASTM, D-1890-65).

A petroleum refinery residuum such as fluidized catalytic cracker (FCC) "main column" bottoms or thermofor catalytic cracker (TCC) "syntower" bottoms contains a substantial proportion of polycyclic aromatic hydrocarbon and thiophenic constituents such as naphthalene, dimethylnaphthalene, anthracene, phenanthrene, fluorene, chrysene, pyrene, perylene, diphenyl, benzothiophene, dibenzothiophene, tetralin, dihydronaphthalene, and the like.

A typical FCC main column bottoms (or FCC clarified slurry oil) contains a mixture of aromatic hydrocarbon and thiophenic constituents as represented in the following mass spectrometric analysis:

| Compounds | Aromatics | Naphthenic/ Aromatics |
|---|---|---|
| Alkyl-Benzenes | 0.4 | |
| Naphthene-Benzenes | | 1.0 |
| Dinaphthene-Benzenes | | 3.7 |
| Naphthalenes | 0.1 | |
| Acenaphthenes, (biphenyls) | | 7.4 |
| Fluorenes | | 10.1 |
| Phenanthrenes | 13.1 | |
| Naphthene-phenanthrenes | | 11.0 |
| Pyrenes, fluoranthenes | 20.5 | |
| Chrysenes | 10.4 | |
| Benzofluoranthenes | 6.9 | |
| Perylenes | 5.2 | |
| Benzothiophenes | 2.4 | |
| Dibenzothiophenes | 5.4 | |
| Naphthobenzothiophenes | | 2.4 |
| Total | 64.4 | 35.6 |

A typical FCC main column bottoms has the following nominal analysis and properties:

| Elemental Analysis, Wt. % | |
|---|---|
| C | 89.93 |
| H | 7.35 |
| O | 0.99 |
| N | 0.44 |

-continued

| | |
|---|---|
| S | 1.09 |
| Total | 99.80 |
| Pour Point, °F.: 50 | |
| CCR, %: 9.96 | |
| Distillation: | |
| IBP, °F.: | 490 |
| 5%, °F.: | 800 (est.) |
| 95%, °F.: | 905 |

FCC main tower bottoms are formed during the catalytic cracking of gas oil in the presence of a solid porous catalyst. A more complete description of the production of this petroleum fraction is disclosed in U.S. Pat. No. 3,725,240.

$C_1$–$C_4$ Alkanol Component

An important aspect of the present invention process is the incorporation of a $C_1$–$C_4$ alkanol component in the feed stream. Suitable $C_1$–$C_4$ alkanols include methanol, ethanol, 1-propanol, isopropyl alcohol, 1-butanol, 2-butanol, isobutyl alcohol and tertiary-butyl alcohol.

The $C_1$–$C_4$ alkanol component is employed in a quantity which can vary over a broad range, depending on such factors as the quantity of thiophenic sulfur present in the feed stream, the level of desulfurization desired, the level of the reaction zone temperature, and the like. The quantity of $C_1$–$C_4$ alkanol employed can vary in the range between about 1 and 100 weight percent, based on the weight of oil feed. In most cases, the quantity of $C_1$–$C_4$ alkanol employed will be in the range between about 5 and 50 weight percent, based on the weight of oil feed.

The advantages of the present invention process are predicated on a desulfurization mechanism which involves the displacement of thiophenic sulfur atoms with oxygen atoms. The displaced sulfur atoms evolve from the oil feed as an element of volatile compounds.

While reactions of the displacment of oxygen with sulfur in heterocyclic compounds occur readily, the reverse reaction is thermodynamically unfavorable. However, as corroborated by thermodynamic calculations, the displacment of sulfur atoms in thiophene structures with oxygen atoms to form furan derivatives is a favorable process if the source of the oxygen atoms is a $C_1$–$C_4$ alkanol. As illustrated in the accompanying Table with methanol as the species of $C_1$–$C_4$ alkanol, at processing temperatures above about 600° F., the methanol reactant is transformed into dimethyl ether which provides a higher equilibrium constant for the thiophenic sulfur displacement reaction.

TABLE

| Reaction | Equilibrium Constant 400° K. (261° F.) | 900° K. (1161° F.) |
|---|---|---|
| 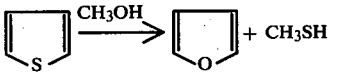 | $3.6 \times 10^{-4}$ | $3.6 \times 10^{-2}$ |
| 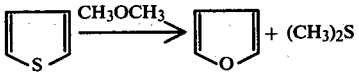 | 7.64 | 4.18 |
| $2CH_3OH \longrightarrow CH_3OCH_3 + H_2O$ | 7.6 | 2.26 |

Zeolite Catalyst Component

In another one of its important aspects, the present invention desulfurization process is conducted in the presence of a non-acidic zeolite catalyst.

The term "non-acidic" zeolite catalysts is meant to include alkali metal and alkaline earth metal forms of zeolites as a preferred class of catalysts.

By the accepted definition, assuming in zeolites one equivalent per aluminum atom, the equivalent ratio of alkali or alkaline earth metal to aluminum is nominally $1 \pm 0.05$. This corresponds to 95 percent or more protonic sites ($H^+$) displaced by alkali or alkaline earth metal cations, such as $Na^+$, $K^+$, $Ca^{++}$, $Mg^{++}$, and the like.

Illustrative of non-acidic zeolite catalysts suitable for the practice of the present invention desulfurization process are the alkali metal and alkaline earth metal forms of the various synthetic crystalline aluminosilicates known in the prior art, such as zeolite X, zeolite Y, ZSM-5, ZSM-11, ZSM-12, ZSM-32, and the like.

The preparation of specific types of crystalline aluminosilicates is described in U.S. Pat. Nos. such as 3,882,243 (zeolite A); 2,882,244 (zeolite X); 3,130,007 (zeolite Y); 3,055,654 (zeolite K-G); 3,247,195 (zeolite ZK-5); 3,308,069 (zeolite Beta); 3,314,752 (zeolite ZK-4); 3,702,886 (ZSM-5); and references cited therein.

Desulfurization Conditions

In a continuous operation, the thiophenic sulfur-containing hydrocarbonaceous oil feed is passed through a catalytic reactor at an oil space velocity (V/V/hr.) between about 0.1 and 10, and preferably between about 0.1 and 4.

The temperature in the reactor system can vary in the range between about 450° F. and 850° F., and preferably in the range between about 550° F. and 650° F., at a psig up to about 500.

The effluent stream from the catalytic reactor is introduced into a fractionator to separate overhead the unreacted alkanol and dialkyl ether, and the alkyl mercaptan and dialkyl sulfide desulfurization products, from the hydrocarbonaceous oil.

By the practice of the invention process, the thiophenic sulfur content of an oil feed can be reduced by at least 60 percent, and under optimal conditions by at least 70 percent.

The following examples are further illustrative of the present invention. The reactants and other specific ingredients are presented as being typical, and various modifications can be devised in view of the foregoing disclosure within the scope of the invention.

EXAMPLE I

A slurry of a solvent refined coal in methanol is introduced into an autoclave containing methanol and a Na zeolite (13-X, Union Carbide) preheated at 600° F. The ratio by weight solvent refined coal:methanol:catalyst is 1:0.5:0.2. The mixture is maintained at 600° F. with continuous stirring for 50 minutes. After quenching, the coal liquid is separated from catalyst by filtration and from unreacted methanol, dimethyl ether, methyl mercaptan and dimethyl sulfide by distillation. The initial and final elemental analyses and the S/O atomic ratio for the coal liquids are:

| | C | H | O | S | S/O |
|---|---|---|---|---|---|
| Initial solvent refined coal | 82.5 | 6.5 | 5.9 | 2.1 | 0.18 |
| Final coal liquid | 86.5 | 6.4 | 5.0 | 0.5 | 0.05 |

The thiophenic sulfur content is reduced from about 1.6 weight percent to about 0.4 weight percent.

EXAMPLE II

An Arab light 650+ residuum (1 part) is mixed with methanol (0.3 part) and preheated sodium zeolite (13-X) (0.2 part) in an autoclave. The mixture is maintained at 600° F. with continuous stirring for 50 minutes. After quenching the petroleum residuum is separated from catalyst by filtration, and then from unreacted methanol, dimethyl ether, methyl mercaptan and dimethyl sulfide by distillation. The initial and final elemental analyses and the S/O atomic ratio for the petroleum residuum are:

| | C | H | O | S | S/O |
|---|---|---|---|---|---|
| Initial Arab light 650+ residuum | 85.2 | 11.4 | 0.1 | 3.1 | 15.5 |
| Final product | 86.0 | 11.8 | 1.1 | 0.9 | 0.4 |

The thiophenic sulfur content is reduced from about 1.6 weight percent to about 0.5 weight percent.

What is claimed is:

1. A process for desulfurizing a thiophenic sulfur-containing heavy hydrocarbonaceous oil feed which comprises reacting the oil feed with a $C_1$–$C_4$ alkanol in the presence of a non-acidic zeolite catalyst selected from alkali metal and alkaline earth metal forms of zeolites at a temperature in the range between about 450° F. and 850° F.

2. A process in accordance with claim 1 wherein the oil feed is a coal-derived synthetic crude oil having a thiophenic sulfur content of at least about 0.5 weight percent.

3. A process in accordance with claim 2 wherein the thiophenic sulfur content of the coal-derived synthetic crude oil is reduced by at least 60 percent.

4. A process in accordance with claim 1 wherein the oil feed is a petroleum refinery residual oil fraction having a thiophenic sulfur content of at least 0.6 weight percent.

5. A process in accordance with claim 4 wherein the thiophenic sulfur content of the coal-derived synthetic crude oil is reduced by at least 60 percent.

6. A process in accordance with claim 1 wherein the $C_1$–$C_4$ alkanol is methanol.

7. A process in accordance with claim 6 wherein the methanol is present in a quantity between about 5 and 50 weight percent, based on the weight of oil feed.

8. A process in accordance with claim 1 wherein the non-acidic zeolite is selected from the alkali and alkaline earth metal forms of ZSM-5, ZSM-8, ZSM-11, ZSM-12 and ZSM-32 zeolites.

9. A process in accordance with claim 1 wherein the non-acidic zeolite is selected from the alkali and alkaline earth metal forms of zeolite X and zeolite Y.

10. A process in accordance with claim 1 wherein the temperature is in the range between about 550° F. and 650° F.

11. A process in accordance with claim 1 wherein the said process is conducted as a continuous operation with an oil space velocity (V/V/hr.) between about 0.1 and 4.

* * * * *